US008247740B2

(12) United States Patent
Nakayama et al.

(10) Patent No.: US 8,247,740 B2
(45) Date of Patent: Aug. 21, 2012

(54) SPARK PLUG, AND ITS MANUFACTURING METHOD

(75) Inventors: Katsutoshi Nakayama, Nagoya (JP); Satoshi Nagasawa, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 505 days.

(21) Appl. No.: 12/532,849

(22) PCT Filed: Mar. 27, 2008

(86) PCT No.: PCT/JP2008/055831

§ 371 (c)(1),
(2), (4) Date: Sep. 24, 2009

(87) PCT Pub. No.: WO2008/123342

PCT Pub. Date: Oct. 16, 2008

(65) Prior Publication Data

US 2010/0084391 A1 Apr. 8, 2010

(30) Foreign Application Priority Data

Mar. 29, 2007 (JP) ..... 2007-087656

(51) Int. Cl.
*H01T 13/32* (2006.01)

(52) U.S. Cl. ..... 219/270; 313/141

(58) Field of Classification Search ..... 313/141
See application file for complete search history.

(56) References Cited

U.S. PATENT DOCUMENTS

| | | | | |
|---|---|---|---|---|
| 4,109,633 | A | 8/1978 | Mitsudo et al. | |
| 4,331,899 | A | 5/1982 | Nishida et al. | |
| 4,700,103 | A * | 10/1987 | Yamaguchi et al. | 313/141 |
| 6,304,022 | B1 | 10/2001 | Matsutani | |
| 6,603,244 | B2 | 8/2003 | Sugiyama et al. | |
| 6,653,767 | B2 | 11/2003 | Morita et al. | |
| 6,798,124 | B2 * | 9/2004 | Hiramatsu | 313/141 |
| 7,554,253 | B2 * | 6/2009 | Koyama et al. | 313/141 |
| 8,013,504 | B2 * | 9/2011 | Kameda et al. | 313/141 |
| 2002/0050775 | A1 * | 5/2002 | Hori | 313/141 |
| 2003/0178925 | A1 | 9/2003 | Kumagai et al. | |
| 2006/0220511 | A1 | 10/2006 | Hanashi et al. | |
| 2009/0066211 | A1 * | 3/2009 | Hartmann et al. | 313/141 |

FOREIGN PATENT DOCUMENTS

| | | | |
|---|---|---|---|
| CN | 2938494 | Y | 8/2007 |
| JP | 5-101869 | | 4/1993 |
| JP | 5159856 | A | 6/1993 |
| JP | 9129356 | A | 5/1997 |
| JP | 2001155840 | A | 6/2001 |

OTHER PUBLICATIONS

Japanese Laid-Open Utility Model Appln No. 02-095190, Jul. 30, 1990, Nomura, Tadamasa. The International Bureau of WIPO, International Preliminary Report on Patentability for PCT/JP2008/055831, Issued on Oct. 20, 2009.

Japanese Patent Office, Japanese Patent Office Action, issued in corresponding Japanese patent application No. 2008074383, Nov. 30, 2010.

SIPO of P.R. China, Office Action, dated May 25, 2011, for counterpart Chinese Patent Application No. 200880007810.2.

* cited by examiner

*Primary Examiner* — Stephen W Smoot

(74) *Attorney, Agent, or Firm* — Stites & Harbison PLLC; Jeffrey A. Haeberlin

(57) ABSTRACT

A spark plug of the present invention includes a cylindrical metal shell, a cylindrical ceramic insulator retained in the metal shell, a center electrode retained in the ceramic insulator and extending in an axial direction, and a ground electrode formed into a bent shape and having a rear end portion fixed to the metal shell and a front end portion facing a front end portion of the center electrode with a gap left therebetween. The ground electrode contains a large thickness region formed on a rear end side thereof with a large thickness, a small thickness region formed on a front end side thereof with a smaller thickness than that of the large thickness region, a protruding region formed on the small thickness region and facing the center electrode and a thickness changing region formed between the large thickness region and the small thickness region and located at a different position from a position of a minimum curvature radius region of the bent shape of the ground electrode.

11 Claims, 8 Drawing Sheets

SPARK PLUG, AND ITS MANUFACTURING METHOD

TECHNICAL FIELD

The present invention relates to a spark plug for use in an automotive internal combustion engine etc. and a manufacturing method thereof.

BACKGROUND ART

A spark plug is known which includes a center electrode and a ground electrode arranged at a discharge gap away from a front end portion of the center electrode so as to generate a spark discharge between the center electrode and the ground electrode for ignition of an air-fuel mixture in a combustion chamber of an internal combustion engine.

Amid recent calls for global environmental protection, it is more strongly demanded to provide energy savings, regulate emissions of carbon dioxide and reduce emissions of unburned gases (hydrocarbon compounds). In order to satisfy these demands, developments are being actively made in internal combustion engines such as lean-burn engine, direct gasoline-injection engine and low emission gas engine. Further, exhaust gas recirculation (EGR) systems, which recirculate a part of exhaust gases into combustion chambers to reduce negative engine loads in intake strokes and produce more cleaner exhaust emissions, are being actively introduced into the lean-burn engines. Under such circumstances, it is required that the spark plug ignites a lean air-fuel mixture containing a large amount of inert exhaust gases. Spark plugs with higher ignition performance are thus needed.

One known type of spark plug with improved ignition performance includes a center electrode having a noble metal tip welded to an electrode body thereof and a ground electrode having a protruding region formed by e.g. welding a cylindrical noble metal tip, with an annular surface of the cylindrical noble metal tip directly facing the noble metal tip of the center electrode, so as to generate a spark discharge between these noble metal tips. There is proposed another type of spark plug in which a ground electrode has a protruding region formed by press forming (See Patent Document 1.)

Patent Document 1: Japanese Laid-Open Patent Publication No. 2006-286469

In the case where the protruding region is formed by welding the noble metal tip to the ground electrode, the spark plug attains improved ignition performance but has a problem of increase in manufacturing cost due to the use of the expensive noble metal tip. In the case where the protruding region of the ground electrode is formed by press forming, the press forming process causes plastic deformation in the ground electrode so that the ground electrode becomes susceptible to breakage. This results in an increased possibility that the ground electrode will break when bent to a substantially L-shaped form during the manufacturing of the spark plug or when subjected to external force during the use of the finished plug product. The spark plug thus has a problem of difficulty in securing durability.

DISCLOSURE OF THE INVENTION

The present invention has been made to solve the above problems. It is an object of the present invention to provide a spark plug that combines good ignition performance, economy and durability.

According to an aspect of the present invention, there is provided a spark plug, comprising: a cylindrical metal shell; a cylindrical ceramic insulator retained in the metal shell; a center electrode retained in the ceramic insulator and extending in an axial direction; and a ground electrode formed into a bent shape and having a rear end portion fixed to the metal shell and a front end portion facing a front end portion of the center electrode with a gap left between the front end portion of the ground electrode and the front end portion of the center electrode, the ground electrode including a large thickness region formed on a rear end side thereof with a large thickness, a small thickness region formed on a front end side thereof with a smaller thickness than that of the large thickness region, a protruding region formed on the small thickness region and facing the center electrode and a thickness changing region formed between the large thickness region and the small thickness region and located at a different position from a position of a minimum curvature radius region of the bent shape of the ground electrode.

According to another aspect of the present invention, there is provided a manufacturing method of a spark plug, the spark plug including: a cylindrical metal shell; a cylindrical ceramic insulator retained in the metal shell; a center electrode retained in the ceramic insulator and extending in an axial direction; and a ground electrode formed into a bent shape and having a rear end portion fixed to the metal shell and a front end portion facing a front end portion of the center electrode with a gap left between the front end portion of the ground electrode and the front end portion of the center electrode, the ground electrode including a large thickness region formed on a rear end side thereof with a large thickness, a small thickness region formed on a front end side thereof with a smaller thickness than that of the large thickness region, a protruding region formed on the small thickness region and facing the center electrode and a thickness changing region formed between the large thickness region and the small thickness region and located at a different position from a position of a minimum curvature radius region of the bent shape of the ground electrode, the manufacturing method comprising: a press forming step for providing the ground electrode with the large thickness region, the small thickness region, the thickness changing region and the protruding region; a bending step for bending the ground electrode to define the minimum curvature radius region in such a manner that the minimum curvature radius region and the thickness changing region differ in position from each other; and a front end shaping step for, after the press forming step, processing the front end portion of the ground electrode into a given shape.

In the spark plug of the present invention, the ground electrode has its thickness changing region formed between the large thickness region and the small thickness region in such a manner that the thickness changing region differs in position from the minimum curvature radius region of the bent shape of the ground electrode. It is therefore possible to prevent the occurrence of a breakage in the ground electrode and secure durability.

BEST MODE FOR CARRYING OUT THE INVENTION

Figure 1:
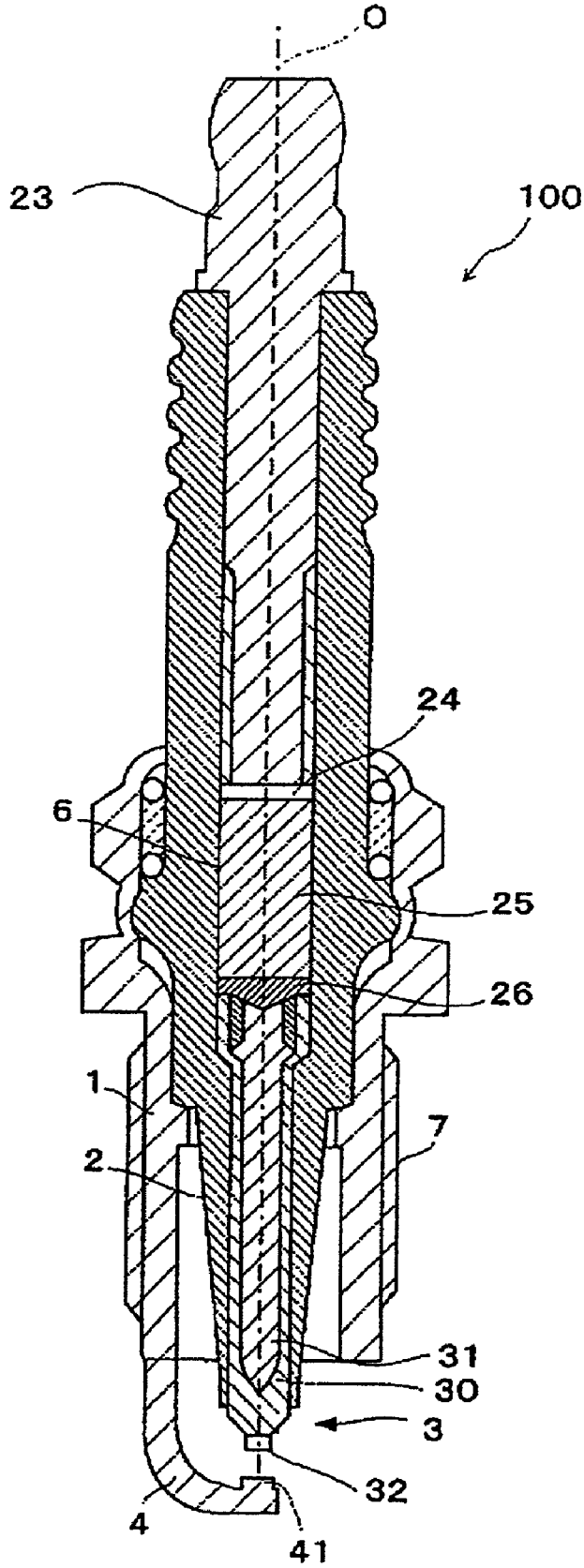
FIG. 1 is a general section view of a spark plug according to one embodiment of the present invention.

The present invention will be described in detail below with reference to the drawings. Herein, like parts and portions are designated by like reference numerals to avoid repeated explanations thereof.

As shown in FIG. 1, a spark plug 100 according to one embodiment of the present invention includes a metal shell 1, a ceramic insulator 2, a center electrode 3 and a ground electrode 4.

The metal shell 1 is made of metal such as low carbon steel and formed into a cylindrical shape. A threaded portion 7 is formed on an outer circumferential surface of the metal shell 1 and adapted for mounting the spark plug 100 onto an engine block (not shown).

The ceramic insulator 2 is made of sintered ceramic such as alumina or aluminum nitride and retained in the metal shell 1 with a front end portion of the ceramic insulator 2 protruding from an end face of the metal shell 1.

A through hole 6 is formed through the ceramic insulator 2 in the direction of an axis O. The center electrode 3 is arranged in a front side (bottom side in the drawing) of the through hole 6 with a front end portion of the center electrode 3 protruding from an end face of the ceramic insulator 2. This center electrode 3 has a center electrode body 30 as a surface layer part and a noble metal tip 32 welded to a front end of the center electrode body 30. The center electrode body 30 is made of Ni-based alloy and formed into a cylindrical column shape. The center electrode 3 also has a thermal conduction enhancing member of Cu or Cu alloy embedded in the electrode body 30. The noble metal tip 32 can be made of Ir alloy containing Ir as a main component and 3 to 50 mass % of one or more selected from Pt, Rh, Ru and Re in total as a sub-component to not only limit oxidation/volatilization of Ir but obtain improvement in workability and have a cylindrical column outer shape with a diameter of 0.6 mm. A terminal fitting 23 is arranged in a rear side of the though hole 6 of the ceramic insulator 2 and electrically connected to the center electrode 3 via a radio noise reducing resistor 25 and conductive glass seal layers 24 and 26.

Figure 2:
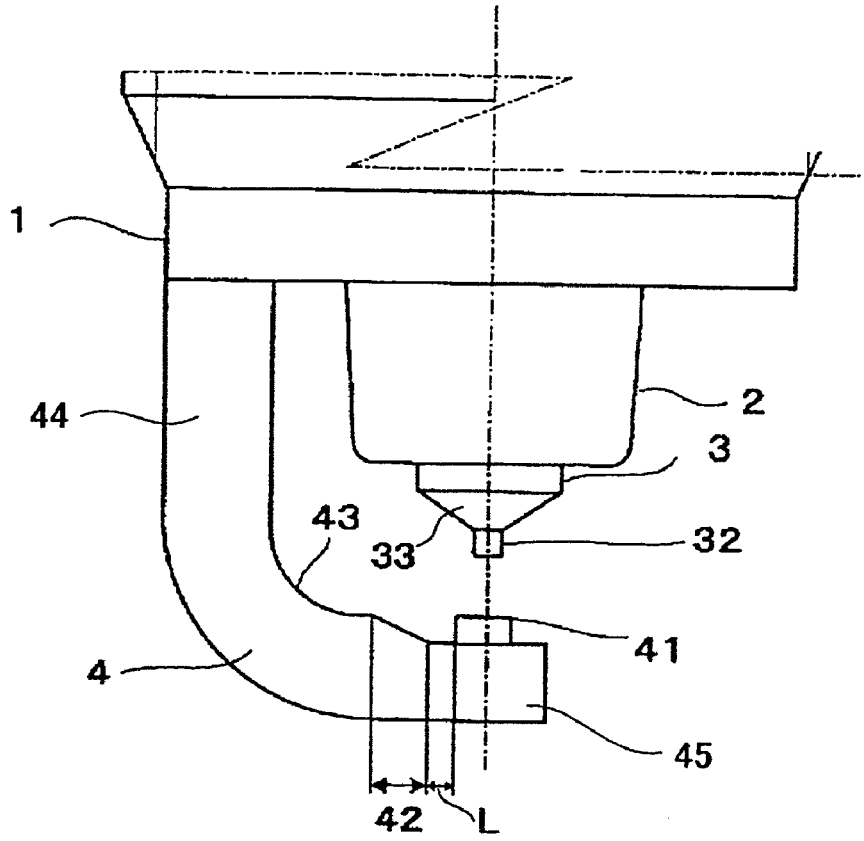
FIG. 2 is an enlarged view of substantial part of the spark plug of FIG. 1.

The ground electrode 4 is bent to a substantially L-shaped form and arranged to have one end portion (rear end portion) thereof joined to the front end face of the metal shell 1 and the other end portion (front end portion) facing a front end of the noble metal tip 32 of the center electrode 3. As is also shown in FIG. 2, this ground electrode 4 includes a large thickness region 44 formed on a rear end side thereof with a large thickness (plate thickness in a direction perpendicular to a longitudinal direction of the ground electrode 4), a small thickness region 45 formed on a front end side thereof with a smaller thickness than that of the large thickness region 44 and a column-shaped protruding region 41 formed on the small thickness region 45 so as to face and protrude toward the noble metal tip 32. In the present embodiment, the protruding region 41 has a cylindrical column outer shape with a diameter of 1.0 mm and a height of 0.3 mm. For improvements in ignition performance and heat resistance and reduction in manufacturing cost, the ground electrode 4 including the protruding region 41 can be made of e.g. Ni-based alloy. The column-shaped protruding region 41 is formed by press forming as will be explained later. The ground electrode 4 further includes a thickness changing region 42 formed between the large thickness region 44 and the small thickness region 45 during the press forming process and located at a different position from a position of a minimum curvature radius region 43 in which the bent shape of the ground electrode 4 has a minimum radius of curvature as shown in FIG. 2.

In the case where the thickness changing region 42 is formed on the front end side of the ground electrode 4 with respect to the minimum curvature radius region 43, it is preferable that the thickness changing region 42 has a front end side (small thickness region side) facing a shoulder portion 33 of the center electrode 3 in the direction of the axis O and a rear end side (large thickness region side) facing the front end face of the ceramic insulator 2 in the direction of the axis O. In the present embodiment, a part of the thickness changing region 42 is located at a position overlapping the shoulder portion 33 of the center electrode 3 in the direction of the axis O.

It is further preferable to set a minimum distance L between the protruding region 41 and the thickness changing region 42 to 0.3 mm or larger (e.g. L=0.5 mm). When the thickness changing region 42 is located away from the protruding region 41 in this way, it is possible to provide improvement in ignition performance by preventing the thickness changing region 42 from interfering with flame core growth.

In the spark plug 100, the column-shaped protruding region 41 is formed by press forming on the ground electrode 4 so as to face the noble metal tip 32 as mentioned above. This protruding region 41 performs the same function as a noble metal tip provided on the ground electrode 4. It is thus possible to provide improvement in ignition performance. It is also possible to avoid the necessity for the expensive noble metal tip and the laser welding process and provide substantial reduction in manufacturing cost as compared with the case of laser welding the noble metal tip to the ground electrode 4.

Although the noble metal tip 32 is provided on the center electrode 3 as shown in FIGS. 1 and 2, the center electrode 3 may alternatively have no noble metal tip 32 for further reduction in manufacturing cost. In this case, the center electrode 3 and the protruding region 41 can be cylindrical column-shaped with a diameter of 2.5 mm and 2.9 mm, respectively.

Figure 3A:
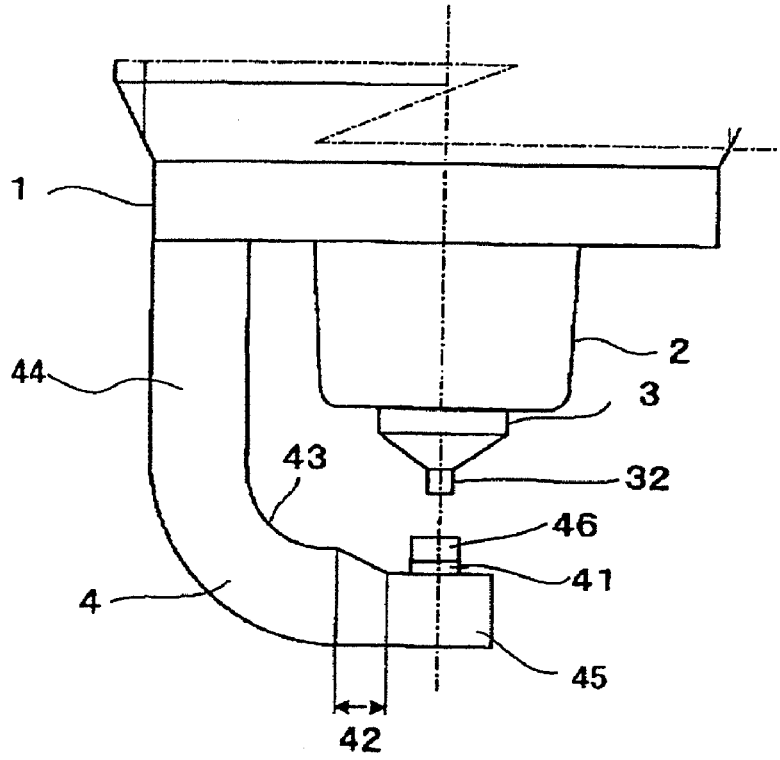
FIG. 3A is an enlarged view of substantial part of a spark plug according to another embodiment of the present invention.
Figure 3B:
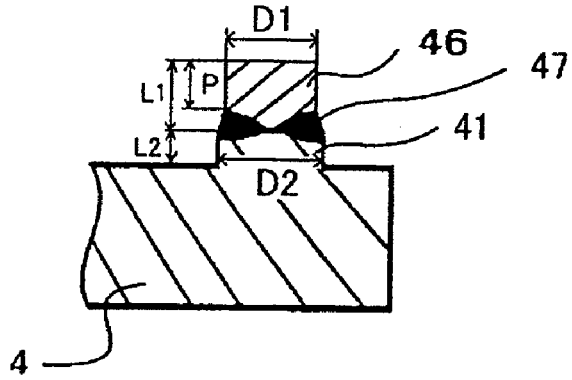
FIG. 3B is a section view of a ground electrode of the spark plug of FIG. 3A.

As shown in FIGS. 3A and 3B, a noble metal tip 46 of e.g. Pt alloy can be further provided on the column-shaped protruding region 41 of the ground electrode 4. This configuration reduces the volume (amount) of the noble metal tip required as compared with the case of providing the noble metal tip directly on the flat ground electrode 4 without the column-shaped protruding region 41. It is thus possible to provide not only improvements in ignition performance and durability but reduction in manufacturing cost. The noble metal tip 46 and the protruding region 41 of the ground electrode 4 are joined together by laser welding. More specifically, the noble metal tip 46 is first placed on the protruding region 41. The boundary of the protruding region 41 and the noble metal tip 46 is subsequently irradiated with a laser, thereby forming a fused region 47 in which constituent materials of the protruding region 41 and the noble metal tip 46 are fused together to join the protruding region 41 and the noble metal tip 46. It is herein defined that: D1 is an outer diameter of the noble metal tip 46; L1 is a height of the noble metal tip 46; P is a height of protrusion of the noble metal tip 46 from the fused region 47; D2 is an outer diameter of the protruding region 41; and L2 is a height of the protruding region 41. When the outer diameter D1 of the noble metal tip 46 is set smaller than the outer diameter D2 of the protruding region 41 (D1<D2), it is possible to provide improvement in ignition performance while increasing the welding strength between the noble metal tip 46 and the protruding region 41. Moreover, it is possible to ensure a sufficient width of the fused region 47, secure a sufficient height P of protrusion of the noble metal tip 46 from the fused region 47 and thereby provide further improvements in ignition performance and welding strength of the protruding region 41 and the noble metal tip 46 when each of the height L1 of the noble metal tip 46 and the height P of protrusion of the noble metal tip 46 from the fused region 47 is set larger than the height L2 of the protruding region 41 (L1>L2, P>L2). For example, the outer diameter D1 of the noble metal tip 46, the height L1 of the noble metal tip 46, the protrusion height P of the noble metal tip 46 from the fused region 47, the outer diameter D2 of the protruding region 41 and the height L2 of the protruding region 41 can be set to 0.7 mm, 0.6 mm, 0.4 mm, 1.2 mm and 0.3 mm, respectively.

Figure 4:
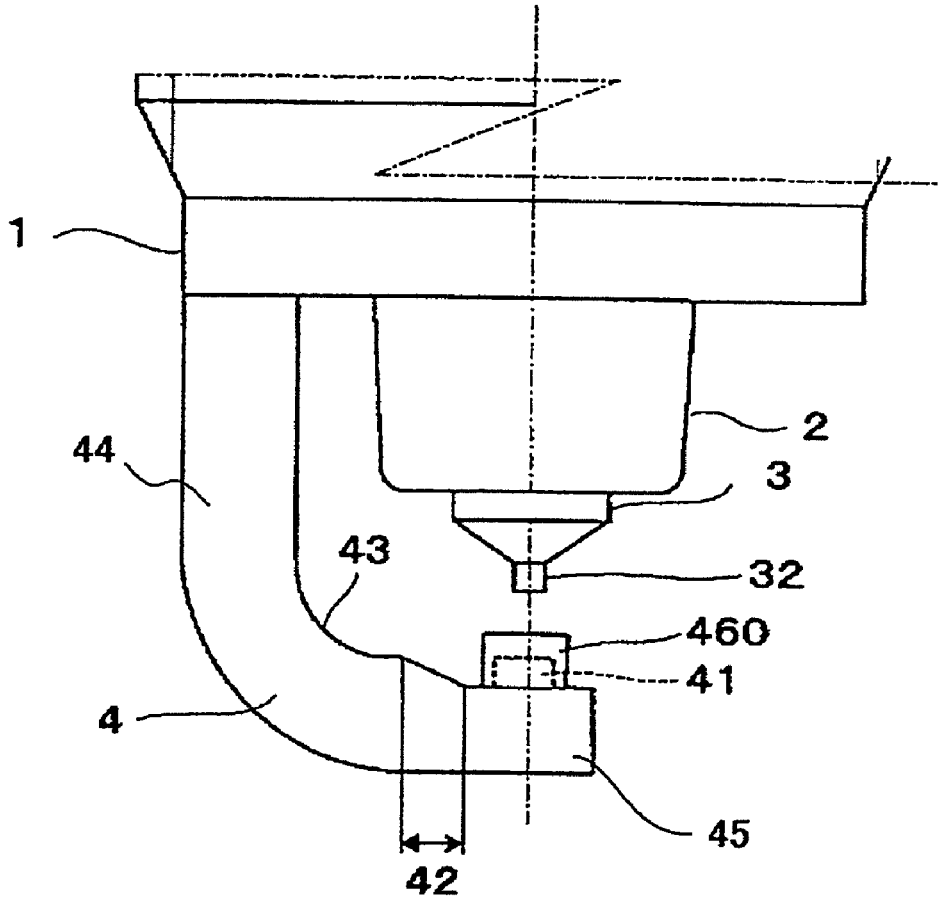
FIG. 4 is an enlarged view of substantial part of a spark plug according to still another embodiment of the present invention.
Figure 5:
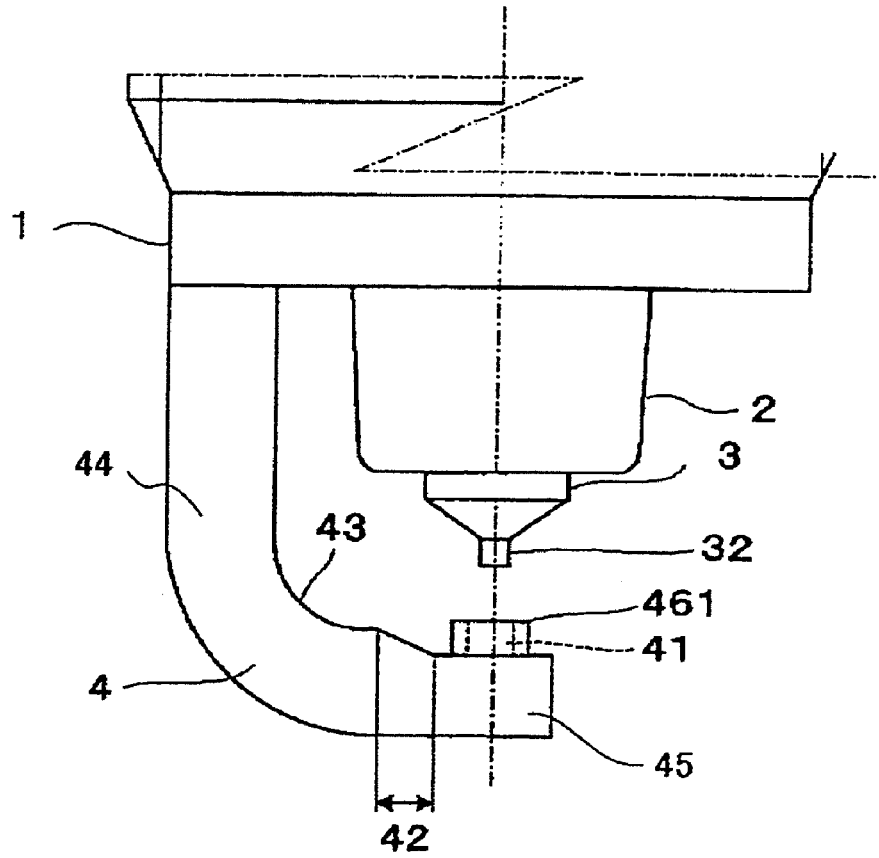
FIG. 5 is an enlarged view of substantial part of a spark plug according to yet another embodiment of the present invention.

Alternatively, a noble metal tip 460 with a recess in a bottom thereof may be used by fitting the column-shaped protruding region 41 in the recess of the noble metal tip 460 as shown in FIG. 4. As shown in FIG. 5, an annular noble metal tip 461 with a center circular hole may alternatively be used by fitting the column-shaped protruding region 41 in the circular hole of the noble metal tip 461.

Further, the thickness changing region 42 and the minimum curvature radius region 43 are located at the different positions in the spark plug 100 as mentioned above. With this location, it is possible to prevent the ground electrode 4 from breaking when the ground electrode 4 is bent to a substantially L-shaped form during the manufacturing process and from breaking by external force or vibrations when the finished product is mounted to and used in an automotive engine etc.

In the case where the column-shaped protruding region 41 is formed by press forming on the ground electrode 4, the periphery of the protruding region decreases in thickness to inevitably define the thickness changing region 42 between the pressed part and the unpressed part. On the other hand, when the ground electrode 4 is subjected to bending, the minimum curvature radius region 43 is most stressed and susceptible to breakage in the ground electrode 4. If the minimum curvature radius region 43 and the thickness changing region 42 coincide in position with each other, it is more likely that the breakage will occur in the ground electrode 4. It is however possible to prevent the ground electrode 4 from readily breaking when the minimum curvature radius region 43 and the thickness changing region 42 differ in position from each other.

Figure 6:
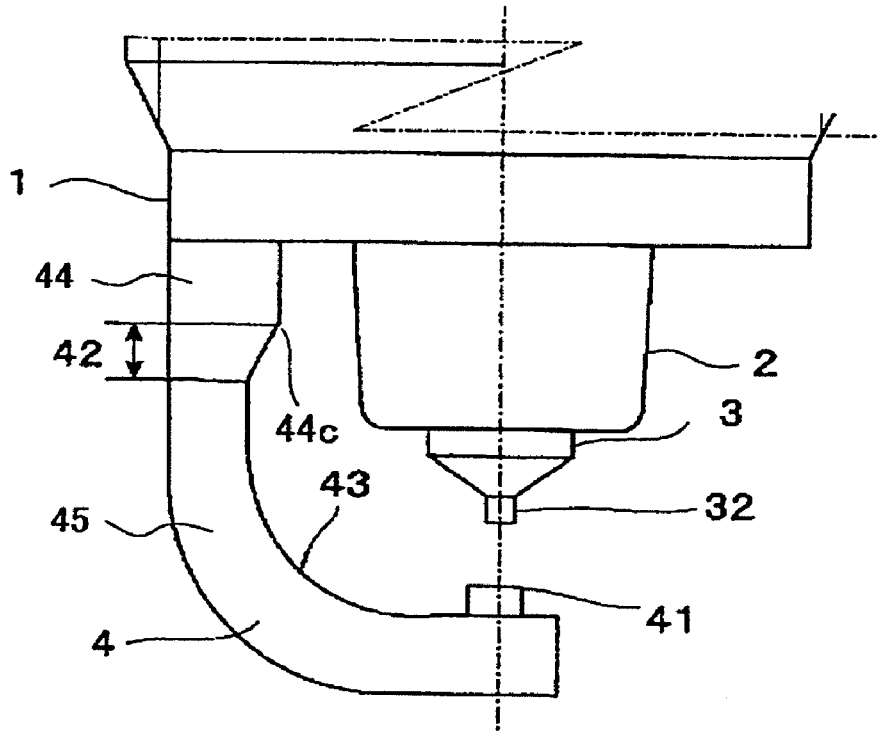
FIG. 6 is an enlarged view of substantial part of a spark plug according to a further embodiment of the present invention.

In the present embodiment, the thickness changing region 42 is located on the front end side of the ground electrode 4 with respect to the minimum curvature radius region 43 as shown in FIG. 2. The thickness changing region 42 may alternatively be located on the rear end side (metal shell side) of the ground electrode 4 with respect to the minimum curvature radius region 43 as shown in FIG. 6. In this case, it is preferable that the large thickness region 44 has a front end edge 44*c* (i.e. edge between the thickness changing region 42 and the large thickness region 44) situated rearward of the front end of the ceramic insulator 2 in the direction of the axis O. It is further preferable to adjust a gap G1 between the protruding region 41 and the noble metal tip, a gap G2 between the front end edge 44*c* of the large thickness region 44 and the ceramic insulator 2 and a gap G3 between the front end edge 44*c* of the large thickness region 44 and the center electrode 3 along a surface of the ceramic insulator 2 so as to satisfy a relationship of G2<G1<G3 and thereby allow the front end edge 44*c* of the large thickness region 44 to serve as a surface creepage portion for cleaning.

There is a case where it becomes difficult to bend the ground electrode 4 as the hardness of the ground electrode 4 increases by work hardening during the press forming process. In terms of the bending process, it is preferable to perform the press forming process only on the front end side of the ground electrode 4 so as to limit the hardness of any regions other than the protruding region 41 and the small thickness region 45 to a low level as in the case of the present embodiment.

Figure 7:
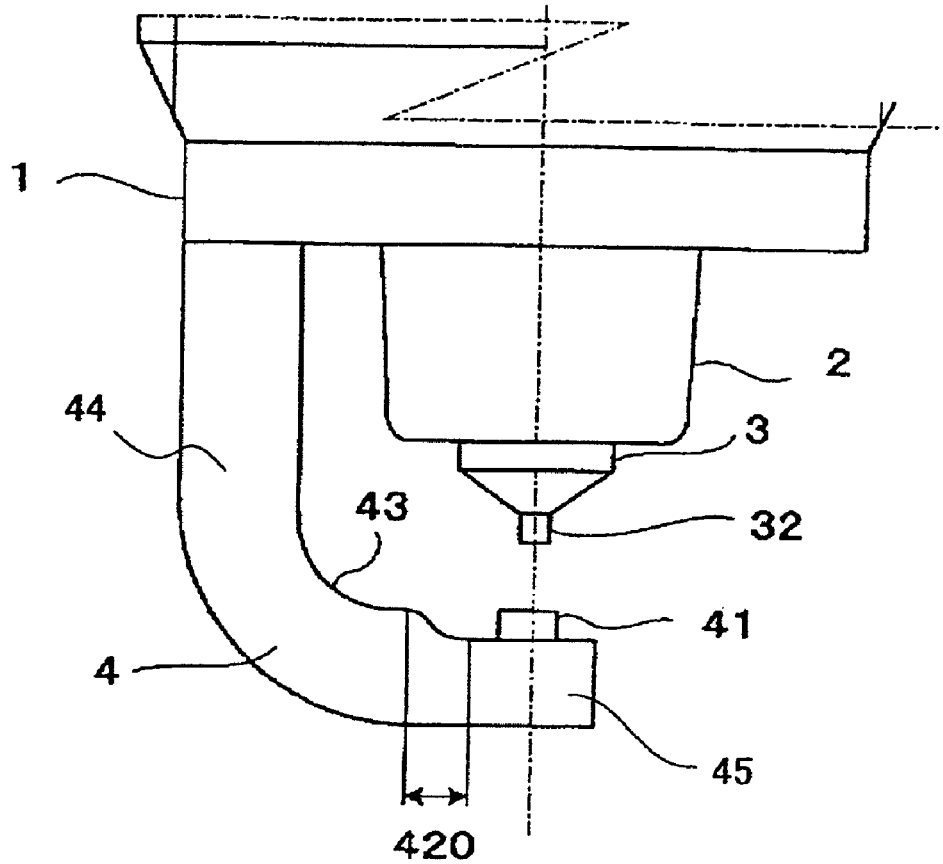
FIG. 7 is an enlarged view of substantial part of a spark plug according to a still further embodiment of the present invention.

As shown in FIG. 2, the thickness of the thickness changing region 42 of the ground electrode 4 changes gradually and smoothly so that the thickness changing region 42 has a tapered cross section in the direction of the axis O. By changing the thickness of the thickness changing region 42 smoothly, it possible to prevent the ground electrode 4 from readily breaking as compared with the case of changing the thickness sharply in a stepwise manner. The ground electrode 4 may alternatively be provided with a thickness changing region 42 whose thickness changes gradually and smoothly such that the thickness changing region 42 has a curved cross section in the axis direction as shown in FIG. 7.

Figure 8:
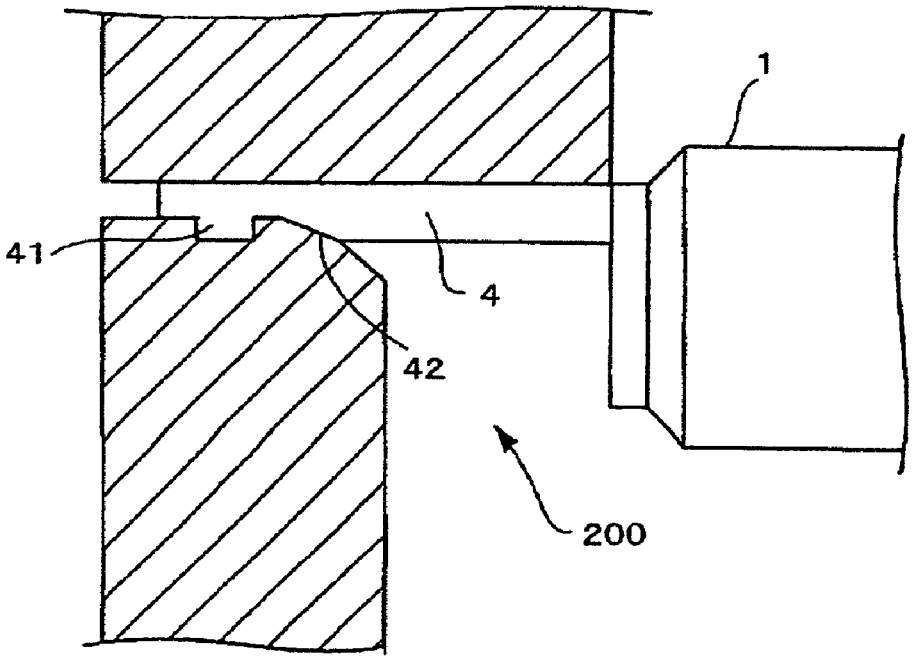
FIG. 8 is a schematic view showing a manufacturing method for the spark plug of FIG. 1.

In the case of forming the column-shaped protruding region 41 and the tapered thickness changing region 42 by press forming on the ground electrode 4, it is feasible to press the front end side of the ground electrode 4 using a press die 200, which has a recessed region corresponding to the column-shaped protruding region 41 and a tapered region corresponding to the tapered thickness changing region 42 as shown in FIG. 8, so as to form the column-shaped protruding region 41 and the tapered thickness changing region 42 simultaneously after welding the ground electrode 4 to the metal shell 1.

Figure 9:
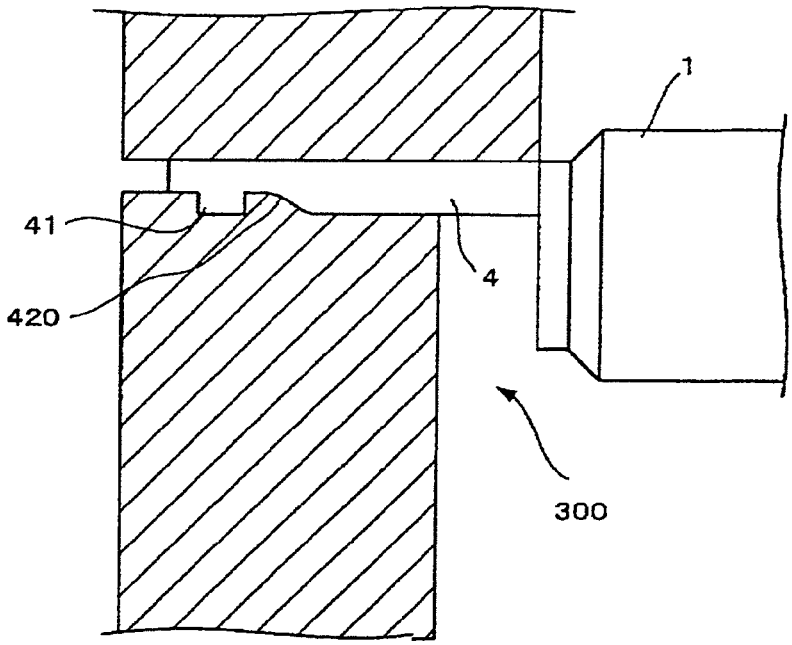
FIG. 9 is a schematic view showing a manufacturing method for the spark plug of FIG. 7.

In the case of forming the column-shaped protruding region 41 and the curved thickness changing region 42 by press forming on the ground electrode 4, it is feasible to press the front end side of the ground electrode 4 using a press die 30, which has a recessed region corresponding to the column-shaped protruding region 41 and a curved region corresponding to the curved thickness changing region 42 as shown in FIG. 9, so as to form the column-shaped protruding region 41 and the tapered thickness changing region 42 simultaneously after welding the ground electrode 4 to the metal shell 1.

By press forming the column-shaped protruding region 41 etc. integrally on the ground electrode 4 as mentioned above, it is possible to enable mass production in a short time and provide substantial reduction in manufacturing cost as compared with the case of laser welding the noble metal tip.

In the case where the ground electrode 4 increases in hardness by work hardening during the press forming process and thus becomes difficult to bend, it is feasible, after the press forming process, to anneal the ground electrode 4 for ease of the subsequent process of bending the ground electrode 4 to a substantially L-shaped form. When the ground electrode 4 is annealed before welded to the metal shell 1, only the ground electrode 4 can be subjected to annealing. This makes it possible to manufacture the spark plug 100 more efficiently for reduction in manufacturing cost.

Although the form of the column-shaped protruding region 41 is not particularly restricted, it is preferable that the protruding region 41 has a cross section area of 0.1 $mm^2$ to 6.6 $mm^2$ in a direction perpendicular to the axis direction for compatibility between ignition performance and durability.

Figure 10:
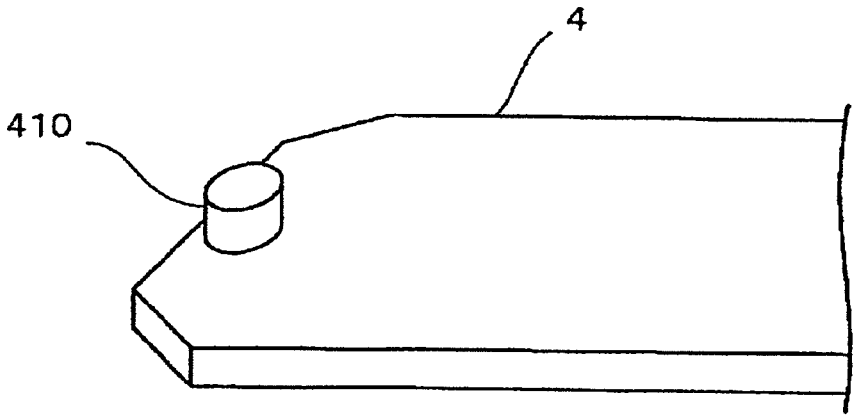
FIG. 10 is a modification of a ground electrode protruding region of the spark plug according to the embodiment of the present invention.
Figure 11:
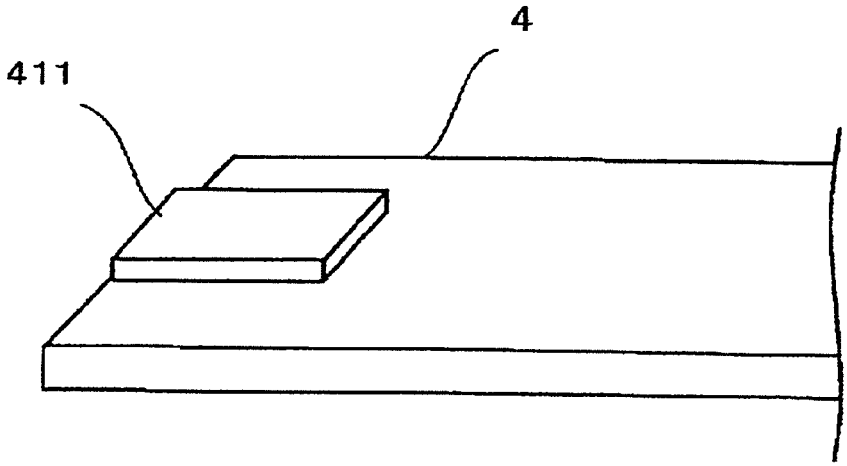
FIG. 11 is a modification of a ground electrode protruding region of the spark plug according to the embodiment of the present invention.
Figure 12:
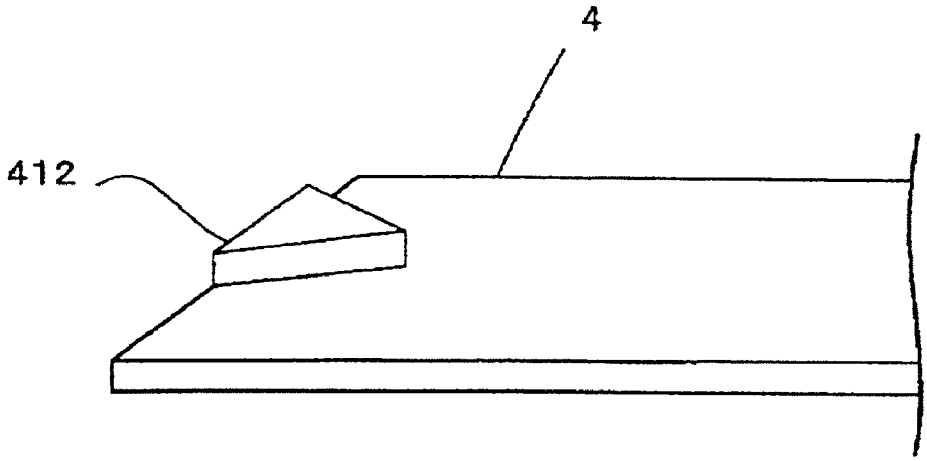
FIG. 12 is a modification of a ground electrode protruding region of the spark plug according to the embodiment of the present invention.
Figure 13:
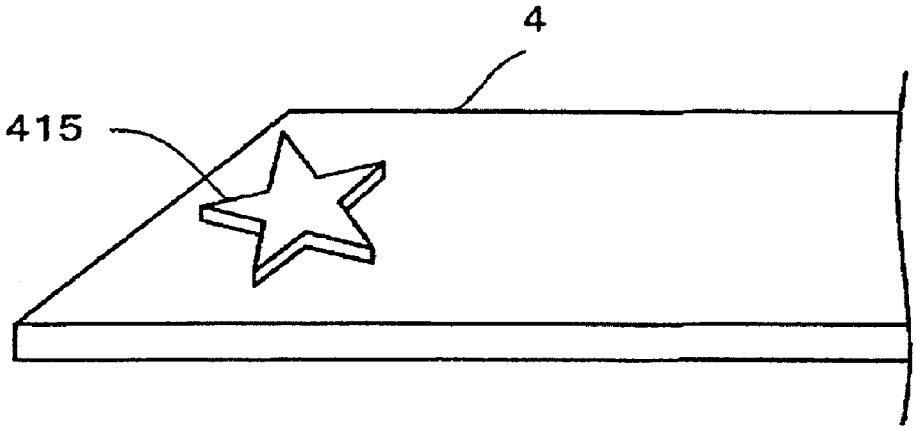
FIG. 13 is a modification of a ground electrode protruding region of the spark plug according to the embodiment of the present invention.
Figure 14:
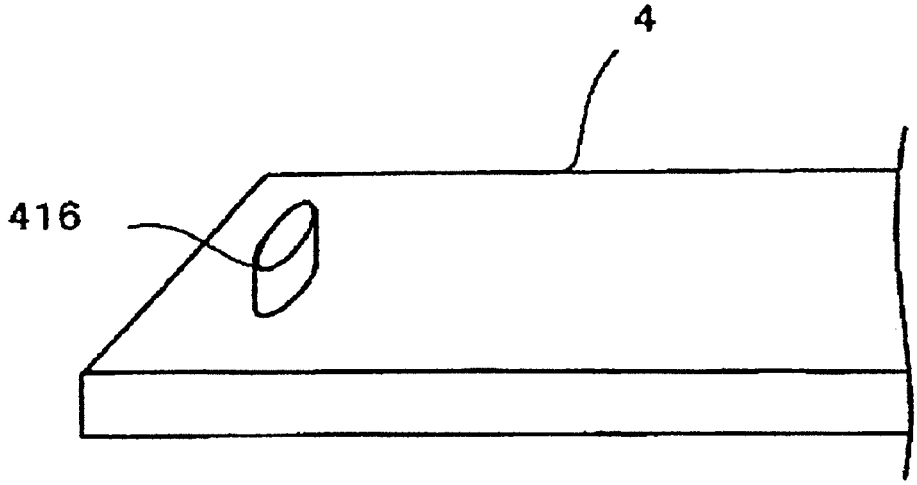
FIG. 14 is a modification of a ground electrode protruding region of the spark plug according to the embodiment of the present invention.
Figure 15:
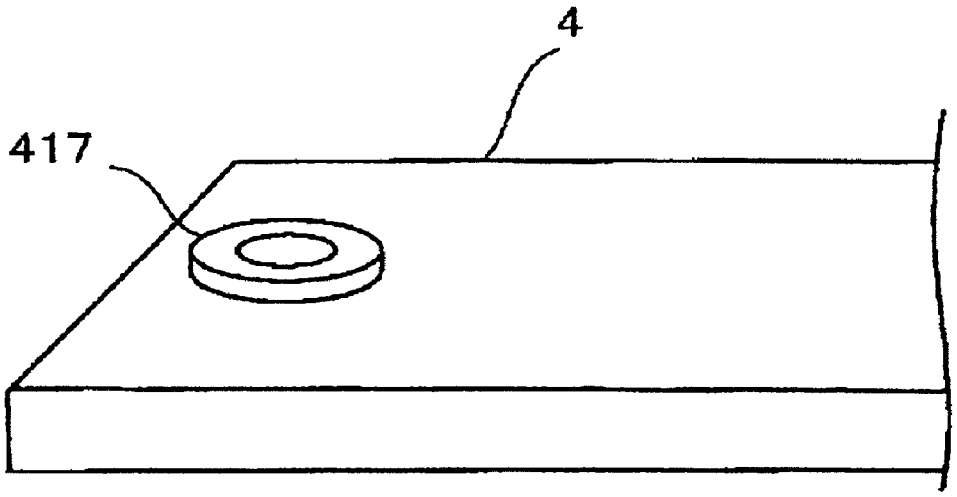
FIG. 15 is a modification of a ground electrode protruding region of the spark plug according to the embodiment of the present invention.

For example, modifications can be made to the column-shaped protruding region 41 as shown in FIGS. 10 to 15. In the modification of FIG. 10, a cylindrical column-shaped protruding region 410 is formed on the front end portion of the ground electrode 4 with both of lateral corners of the front end of the ground electrode 4 being cut away. In the case of processing the ground electrode 4 into the shape that both of the lateral edges of the front end of the ground electrode 4 are cut away as shown in FIG. 10, it is preferable to perform such shaping process after press forming the protruding region 41 on the ground electrode 4. This allows the front end portion of the ground electrode 4 to be processed into any desired shape. In the modification of FIG. 11, a square column-shaped protruding region 411 is formed on the front end portion of the ground electrode 4. In the modification of FIG. 12, a triangular column-shaped protruding region 412 is formed on the front end portion of the ground electrode 4. In the modification of FIG. 13, a protruding region 415 is provided in the form of a star-shaped column at a position slightly rearward from the front end edge of the ground electrode 4. In the modification of FIG. 14, an elliptic cylinder-shaped protruding region 416 is formed at a position slightly rearward from the front end edge of the ground electrode 4. In the modification of FIG. 15, a cylindrical column-shaped protruding region 417 having a circular depression in the center thereof is formed at a position slightly rearward from the front end edge of the ground electrode 4.

Figure 16:
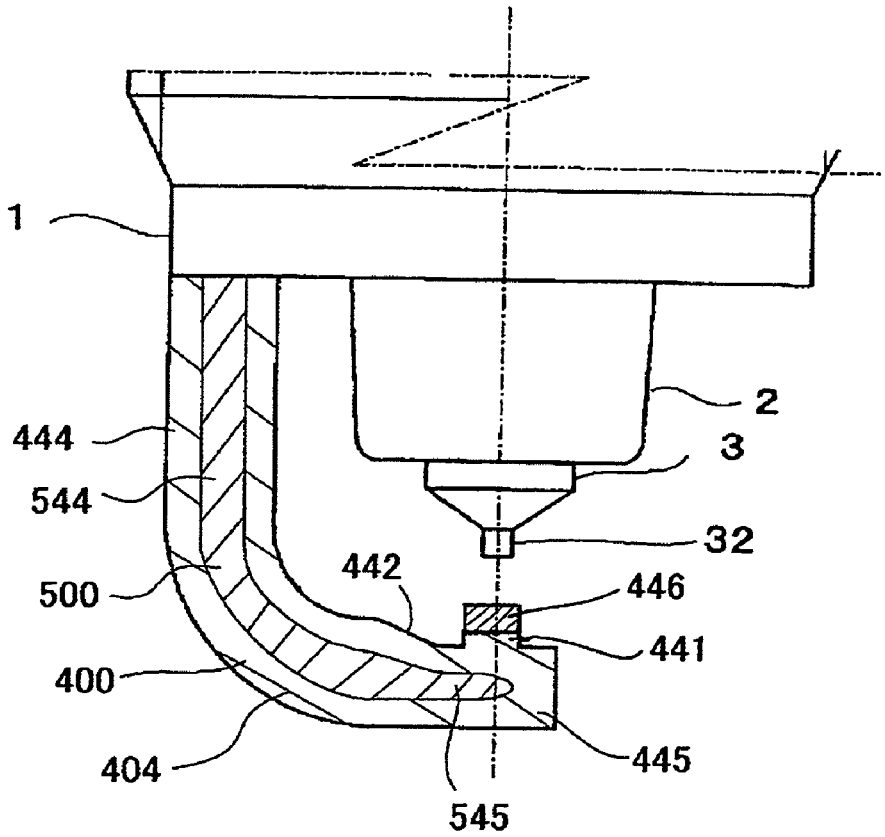
FIG. 16 is an enlarged view of substantial part of a spark plug according to a yet further embodiment of the present invention.

Furthermore, there can alternatively be used a ground electrode 400 having a ground electrode body 404 and a thermal conduction enhancing member (high thermal conduction member) 500 of Cu or Cu alloy embedded in the electrode body 404 as shown in FIG. 16. The ground electrode thermal conduction enhancing member 500 extends from a large thickness region 444 to a position of a protruding region 441 on a small thickness region 445 through a thickness changing region 422 of the ground electrode 400. When the ground electrode thermal conduction enhancing member 500 extends to and exists in the small thickness region 445, it is possible to enable efficient thermal conduction of the small thickness region 445 and limit consumption of the protruding region 441 and the noble metal tip 446 joined to the protruding region 441. Further, a part 545 of the ground electrode thermal conduction enhancing member 500 existing in the small thickness region 445 is made smaller in thickness than a part 544 of the ground electrode thermal conduction enhancing member 500 existing in the large thickness region 444. It is thus possible to minimize the mechanical strength deterioration effect caused by embedding the high thermal conduction member 500 and secure not only efficient thermal conduction but also mechanical strength.

As described above, the spark plug 100 of the present invention combines good ignition performance, economy and durability.

Although the present invention has been described with reference to the above specific embodiments, the invention is not limited to these exemplary embodiments. Various modifications and variations of the embodiments described above will occur to those skilled in the art in light of the above teachings.

The invention claimed is:

1. A spark plug, comprising:

a cylindrical metal shell;

a cylindrical ceramic insulator retained in the metal shell;

a center electrode retained in the ceramic insulator and extending in an axial direction;

a ground electrode formed into a bent shape and having a rear end portion fixed to the metal shell and a front end portion facing a front end portion of the center electrode with a gap left between the front end portion of the ground electrode and the front end portion of the center electrode, the ground electrode including a large thickness region formed on a rear end side thereof with a large thickness, a small thickness region formed on a front end side thereof with a smaller thickness than that of the large thickness region, a protruding region formed on the small thickness region and facing the center electrode and a thickness changing region formed between the large thickness region and the small thickness region and located at a different position from a position of a minimum curvature radius region of the bent shape of the ground electrode; and a noble metal tip disposed on the protruding region.

2. The spark plug according to claim 1, wherein the thickness changing region has either a tapered cross section or a curved cross section in the axial direction.

3. The spark plug according to claim 1, wherein the protruding region has a cross section area of 0.1 $mm^2$ to 6.6 $mm^2$ in a direction perpendicular to the axial direction.

4. The spark plug according to claim 1, wherein a minimum distance between the protruding region and the thickness changing region is 0.3 mm or larger.

5. The spark plug according to claim 1, wherein the ground electrode includes an electrode body and a high thermal conduction member having a higher thermal conductivity than that of the electrode body and arranged in the electrode body; the high thermal conduction member extends from the large thickness region to the small thickness region through the thickness changing region; and a part of the high thermal conduction member in the small thickness region is smaller in thickness than a part of the high thermal conduction member in the large thickness region.

6. The spark plug according to claim 1, wherein the thickness changing region is located on a front end side of the ground electrode with respect to a bent region of the bent shape; and any regions of the ground electrode other than the small thickness region and the protruding region are lower in hardness than the small thickness region.

7. The spark plug according to claim 1, wherein the ground electrode including the protruding region is made of Ni-based alloy.

8. The spark plug according to claim 1, wherein the spark plug satisfies the following conditions: D1<D2 and L1>L2 where D1 is an outer diameter of the noble metal tip; L1 is a height of the noble metal tip; D2 is an outer diameter of the protruding region; and L2 is a height of the protruding region.

9. The spark plug according to claim 8, wherein the noble metal tip is joined to the protruding region with a fused region formed therebetween by laser welding so as to satisfy the following condition: P>L2 where P is a height of protrusion of the noble metal tip from the fused region.

10. A manufacturing method of a spark plug, the spark plug including: a cylindrical metal shell; a cylindrical ceramic insulator retained in the metal shell; a center electrode retained in the ceramic insulator and extending in an axial direction; and a ground electrode formed into a bent shape and having a rear end portion fixed to the metal shell and a front end portion facing a front end portion of the center electrode with a gap left between the front end portion of the ground electrode and the front end portion of the center electrode, the ground electrode including a large thickness region formed on a rear end side thereof with a large thickness, a small thickness region formed on a front end side thereof with a smaller thickness than that of the large thickness region, a protruding region formed on the small thickness region and facing the center electrode and a thickness changing region formed between the large thickness region and the small thickness region and located at a different position from a position of a minimum curvature radius region of the bent shape of the ground electrode, the manufacturing method comprising:

a press forming step for providing the ground electrode with the large thickness region, the small thickness region, the thickness changing region and the protruding region;

a bending step for bending the ground electrode to define the minimum curvature radius region in such a manner that the minimum curvature radius region and the thickness changing region differ in position from each other; and a front end shaping step for, after the press forming step, processing the front end portion of the ground electrode into a given shape.

11. The manufacturing method of the spark plug according to claim 10, further comprising:

an annealing step for, after the press forming step, annealing the ground electrode; a welding step for, after said annealing, welding the rear end portion of the ground electrode to the metal shell.

* * * * *